US005411465A

United States Patent [19]

Glen et al.

[11] Patent Number: 5,411,465

[45] Date of Patent: May 2, 1995

[54] SEGMENTED COMPOSITE CENTRIFUGE ROTOR WITH A SUPPORT RING INTERFERENCE FIT ABOUT CORE SEGMENTS

[75] Inventors: Stefan J. Glen, Grants Pass, Oreg.; Bradley D. Carstens, Mountain View, Calif.

[73] Assignee: Beckman Instruments, Inc., Fullerton, Calif.

[21] Appl. No.: 141,435

[22] Filed: Oct. 21, 1993

Related U.S. Application Data

[63] Continuation of Ser. No. 780,656, Oct. 21, 1991, abandoned.

[51] Int. Cl.[6] ..... B04B 5/02

[52] U.S. Cl. ..... 494/16; 494/81

[58] Field of Search ..... 494/16–21, 494/31, 33, 43, 44, 81, 85; 422/49, 72, 102; 74/572, 573 R, 574; 210/360.1, 380.1

[56] References Cited

U.S. PATENT DOCUMENTS

| | | | |
|---|---|---|---|
| 330,779 | 11/1885 | Frederiksen et al. | 494/16 |
| 330,780 | 11/1885 | Frederiksen et al. | 494/16 |
| 2,263,220 | 11/1941 | Mejean | 74/572 X |
| 3,265,296 | 8/1966 | Mitchell . | |
| 3,844,730 | 10/1974 | Laussermair | 494/81 X |
| 3,913,828 | 10/1975 | Roy | 494/81 |
| 4,412,830 | 11/1983 | Strain et al. | 494/16 X |
| 4,427,406 | 1/1984 | Nielsen | 494/16 |
| 4,435,169 | 3/1984 | Romanauskas | 494/20 |
| 4,456,581 | 6/1984 | Edelmann et al. | 422/72 |
| 4,468,269 | 8/1984 | Carey | 156/175 |
| 4,586,918 | 5/1986 | Cole | 494/81 X |
| 4,738,656 | 4/1988 | Piramoon et al. | 494/16 X |
| 4,781,669 | 11/1988 | Piramoon | 494/81 X |
| 4,790,808 | 12/1988 | Piramoon | 494/16 X |
| 4,817,453 | 4/1989 | Breslich, Jr. et al. | 74/572 |
| 4,820,257 | 4/1989 | Ishimaru | 494/16 |
| 4,824,429 | 4/1989 | Keunen et al. | 494/16 |
| 4,991,462 | 2/1991 | Breslich, Jr. et al. | 74/572 |
| 5,057,071 | 10/1991 | Piramoon | 494/16 |

FOREIGN PATENT DOCUMENTS

| | | | |
|---|---|---|---|
| 0283098 | 9/1988 | European Pat. Off. . | |
| 2537281 | 6/1984 | France | 494/16 |
| 2140331 | 3/1972 | Germany | 494/81 |
| 2909393 | 3/1981 | Germany . | |
| 3334655 | 4/1985 | Germany | 494/16 |
| 3341323 | 5/1985 | Germany | 494/16 |
| 3539916 | 11/1986 | Germany | 494/20 |

*Primary Examiner*—David A. Scherbel
*Assistant Examiner*—Charles Cooley
*Attorney, Agent, or Firm*—William H. May; Gary T. Hampson

[57] ABSTRACT

A centrifuge rotor which makes use of a composite ring to support a segmented core body. The core body is segmented into sectors. The core segments are slidably coupled to a hub in a manner such that they can move radially relative to the hub upon centrifugation with substantially no radial tensile stress build up in the coupling between the hub and the core segments and within the segment cores. In another aspect of the present invention, to augment the segmented core rotor, hybrid composite sample holders are utilized to further improve overall strength-to-weight of the rotor. The holders comprise a metal portion and a fiber composite portion integrally molded.

20 Claims, 4 Drawing Sheets

SEGMENTED COMPOSITE CENTRIFUGE ROTOR WITH A SUPPORT RING INTERFERENCE FIT ABOUT CORE SEGMENTS

This is a continuation of application Ser. No. 07/780,656, filed Oct. 21,1991, now abandoned

BACKGROUND OF THE INVENTION

1. Scope of the Invention

The present invention relates to centrifuge rotors, and in particular, to a centrifuge rotor having a segmented core supported by a composite ring.

2. Description of Related Art

Centrifuge rotors have been formed from isotropic metal billets. As the rotor is spun at high speed upon centrifugation, centrifugal forces are generated which result in internal stresses in the rotor. The critical internal stresses are tensile in nature and oriented in the radial and circumferential directions. The magnitude of the internal stresses depends on density, geometry and rotational speed of the rotor. The internal stresses increase with increasing rotation speed until a critical stress state is reached and the rotor structure fails. Functional rotors have holes drilled near their perimeters which necessarily weakens the solid isotropic rotor core.

For ultracentrifuges, hybrid metal and composite rotor systems have been proposed. In U.S. Pat. No. 5,057,071 which has been commonly assigned to the assignee of the present invention, a hybrid centrifuge rotor is disclosed which has an aluminum rotor core body shrink fitted in a ring made of composite material. The ring alters the stress state in the rotor core which results in higher permissible rotation speed before failure of the core. The ring which is made of a material reinforced in the circumferential direction can withstand high circumferential tensile stress. This allows the ring to support the radial centrifugal forces imparted by the core and prevent excessive deformation of the core which would otherwise lead to build-up of internal critical tensile stresses in the core. So far, this hybrid design has been applied to small sample capacity rotors.

However, full advantage of the structural capabilities of the support ring has not been taken by current designs. That is, in the event of rotor failure, the core body will likely fail before failure of the composite support ring.

SUMMARY OF THE INVENTION

The present invention is directed to a centrifuge rotor which makes use of a circumferentially fiber reinforced composite ring to support a segmented core body to more fully exploit the structural capabilities of the support ring. The core body is segmented into sectors. The core segments are slidably coupled to a hub in a manner such that they can move radially relative to the hub upon centrifugation. Thus there is substantially no radial tensile stress build up in the coupling between the hub and the core segments and within the segment cores. The core segments experience predominantly compressive rather than radial and circumferential tensile stresses upon centrifugation. The core segments can be made from lower strength, lower density and lower cost materials without compromising overall rotor performance. This is achieved at the expense of increasing tensile stress in the support ring which is designed to withstand high circumferential tensile stress.

In another aspect of the present invention, to augment the segmented core rotor, hybrid composite sample holders or liners are utilized to further improve overall strength-to-weight of the rotor. The liners comprise a metal portion and a fiber composite portion integrally molded. The metal portion can be machined for close tolerance coupling with a closure means.

DESCRIPTION OF THE ILLUSTRATED EMBODIMENTS

The following description is of the best presently contemplated mode of carrying out the invention. This description is made for purpose of illustrating the general principles of the invention and should not be taken in a limiting sense. The scope of the invention is best determined by reference to the appended claims.

Figure 1:
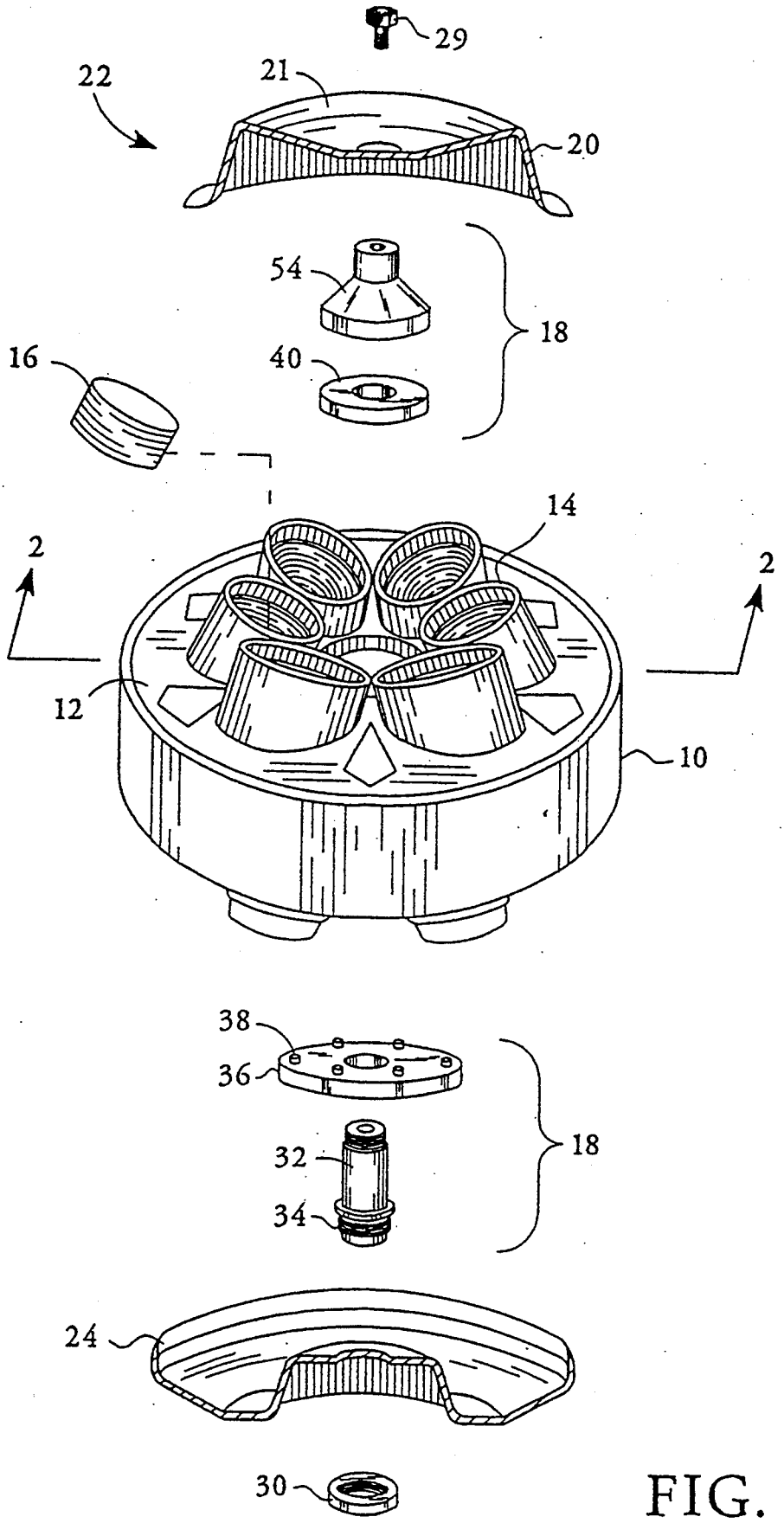
FIG. 1 is a perspective view of a segmented core rotor in accordance with one embodiment of the present invention.
Figure 2:
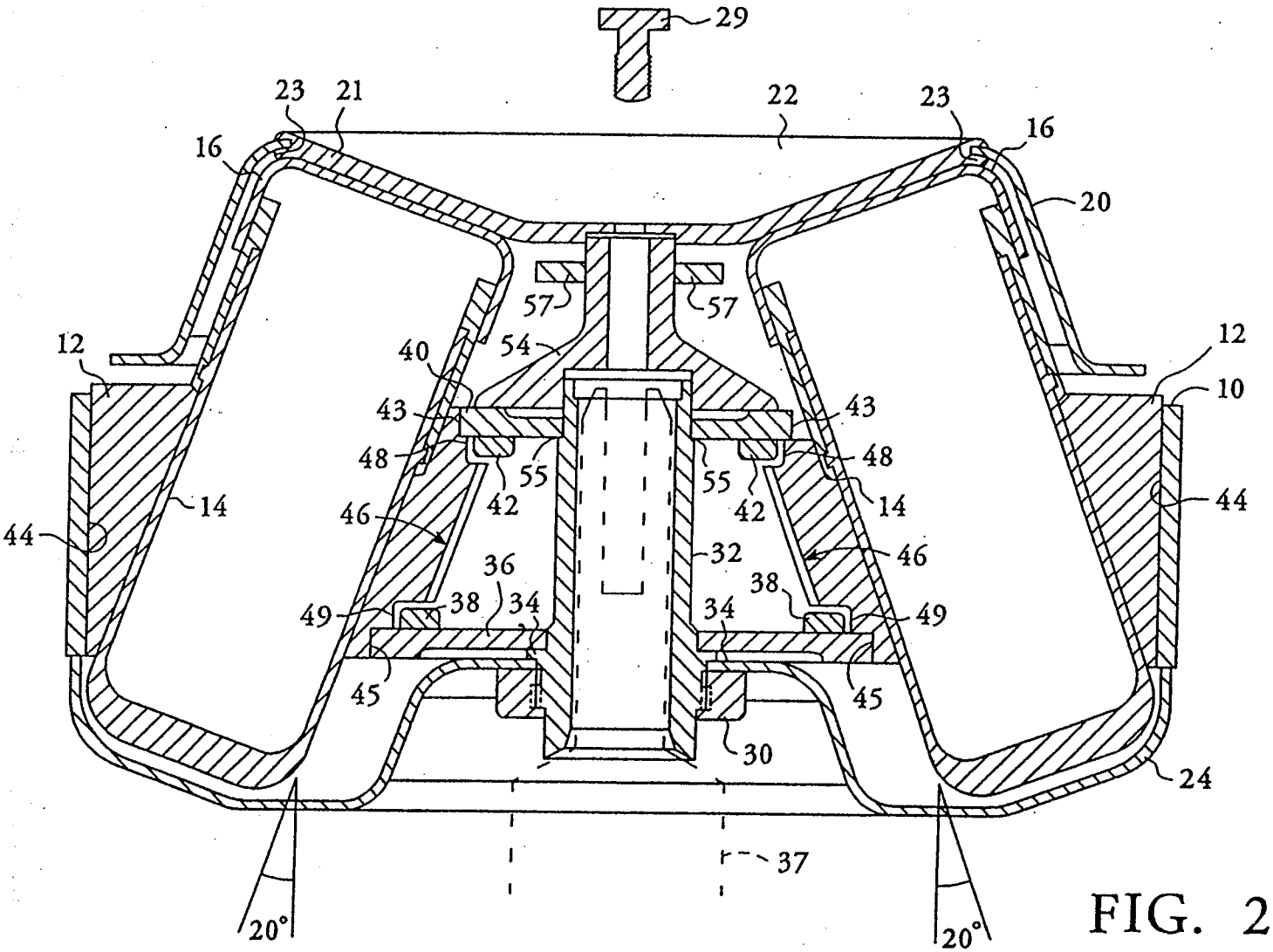
FIG. 2 is a diametral sectional view showing the assembly of the segment core rotor.

FIG. 1 shows the perspective view of a segmented core rotor in accordance with one embodiment of the present invention. The primary components of the rotor includes a support ring 10, sector shaped core segments 12 (FIG. 3) held within the ring 10, cylindrical liners 14 (FIG. 5) held in the core segments 12 for receiving sample containers, aerosol closures 16 for the liners 14, hub assembly 18, top windshield 22 and bottom windshield 24. FIG. 2 is a diametral sectional view more clearly showing the general assembly of the various components.

Referring also to FIG. 2, the hub 18 is an assembly of several parts. A cylindrical stem 32 has a flange 34 near the bottom end. A bottom plate 36 is supported on the flange 34. Six pins 38 are pressed-fitted into holes circumferentially spaced about the center of the plate 36. A top plate 40 having similar pins 42 circumferentially spaced about its center is positioned with the pins 42 facing the pins 38 on the bottom plate 36. A retaining nut 54 tightens the top plate 34 against a small shoulder 55 on the stem. The top and bottom plates 36 and 40 define a specific spacing which will slidably receive the core segments 12 as discussed below. Two rods 57 form a handle for facilitating lifting the rotor assembly from a centrifuge. The hub mechanically interfaces the segmented rotor assembly to the drive shaft 37 (shown in phantom) of the centrifuge.

Figure 3:
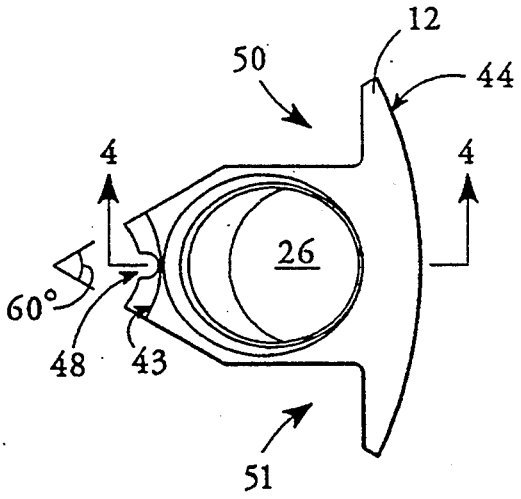
FIG. 3 is a top view of a core segment in accordance with one embodiment of the present invention.
Figure 4:
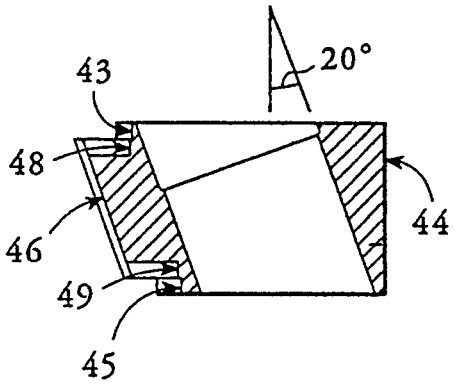
FIG. 4 is a sectional view along line 4—4 in FIG. 3.

The embodiment described herein has six core segments 12, which are best shown in FIGS. 3 and 4, each generally being a sector of 60°. The large end 44 of each segment 12 is radiused conforming generally to the inside radius of the support ring 10. The small end 46 of each segment 12 is radiused with respect to the axis of rotation. A shoulder 43 is formed at the top corner of the small end 46 conforming to the circumference of the plate 40. A shoulder 45 is formed at the bottom corner of the small end 46 conforming to the circumference of the plate 36. Cutout 48 and 49 are formed below and above the shoulders 43 and 45 respectively, sized for receiving pins 42 and 38 respectively. To reduce the weight of the core segment 12, material is removed from the sides 50 and 51 of each core segment 12. Thus, when the core segments 12 are arranged in a circle about the stem 32, they form a disk with hollowed out portions (in addition to the holes 26 for the liners 14).

The core segments 12 are held between the hub 18 and the confine of the ring 10. The core segments 12 are coupled to the hub 18 in a manner which allows the core segments 12 to slide relative to the pins 38 and 42 radially outward when the ring 10 expands upon centrifugation. Specifically, in between the plates 36 and 40, the core segments 12 are fitted with the cutouts 48 and 49 slidably coupling to the pins 42 and 38. The pins 42 and 38 and cutouts 48 and 49 are sized such that upon centrifugation there can be relative sliding of the pins in the cutouts as the core segments 12 are subject to radially outward centrifugation forces.

The liners 14 are removably inserted through the cylindrical slots 26 in the core segments 12, the bottoms of the liners 14 protruding through the core segments 12. In the particular embodiment illustrated, the slots 26 are at an angle (20°) to the rotor axis 28 thus maintaining the liners 14 at an inclined orientation. The closures 16 cover the openings of the liners 14 to prevent aerosol and confine the contents of the liners which might otherwise contaminate the surrounding components and create a hazardous working condition for the user. The construction of the liners 14 and closures 16 will be discussed in greater detail below.

The segmented core is required to serve several vital functions. It geometrically positions each liner 14, the position of which determines the degree of dynamic imbalance. It also provides the interface to the hub 18 at the rotor axis and it is the means by which body loads associated with the liners 14 and their contents are transferred to the support ring 10.

In the static non-centrifuging condition, there is an interference fit between the ring 10 and the core segments 12, the ring 10 biasing the shoulders 43 and 45 of the core segments 12 radially against the top and bottom plates 40 and 36. There is no fixed structural connection between the ring 10 and hub 18 which would be subject to tensile stress upon a centrifuging action. The ring 10 is made of anisotropic fiber reinforced composite material having continuous fibers aligned in a circumferential direction. Accordingly the ring 10 can withstand high circumferential tension stress. This allows the core segments 12 to be made of light metals or fiber-filled plastic material such as a fiber-filled thermal plastic material which has good fracture toughness.

The ring 10 is fabricated using epoxy "spin impregnation" of a dry carbon-tow preform having fibers oriented generally in the circumferential direction. Spin impregnation is a centrifugal process in which a rotating mold incorporates a winding mandrel with the dry preform into a single assembly. The mold is charged with resin and spun under vacuum to achieve impregnation. The part is heated while in the mold to rigidize the structure. Spin impregnation accomplishes the same thing as resin-transfer molding (to be discussed below in connection with fabrication of the liners), but its mold design is simplified for large diameter rings. Alternatively, the ring 10 may be fabricated by "wet-winding", in which continuous carbon fibers wetted with epoxy resin is wound on a mandrel to form the ring. The wound part is then heat cured.

To reduce windage when operating in atmospheric condition, top and bottom windshields 22 and 24 are provided. The windshields 22 and 24 reduce aerodynamic drag and windage noise, such that temperature control can be more easily achieved and power requirements on the centrifuge drive reduced. The top windshield 22 conforms generally to the outlines of the liners 14 and the closures 16. The bottom windshield 24 conforms generally to the bottoms of the liners 14. The windshields together with the exterior of the ring 10 define a relatively smooth overall exterior profile enclosing the uneven structure defined by the liner 14 and the core segments 12. The top windshield 22 comprises two parts, a skirt 20 and a lid 21. The lid 21 is press-fitted into the central opening of the skirt 20. The lid 21 has a lip 23 which latches onto periphery of the central opening of the skirt 20. The lid 21 is secured with the skirt 20 pressing against the top of the core segments 12 by a bolt 29 which is fastened to the centrifuge drive shaft 37. The bottom windshield 24 is secured on the hub 18 with the periphery of the windshield pressed against the bottom surfaces of the core segments 12. A nut 30 is applied to secure the bottom windshield to the hub 18.

The lid 21 also provides the secondary function of containment of the closures 16 on the liners 14 in the event internal pressures become large enough to loosen the closures as might be the case should a centrifuge bottle held in a liner ruptures, which might otherwise cause imbalance of the rotor assembly. The lid 21 is machined from aluminum alloys, and the windshields are molded from carbon fiber/epoxy material.

The advantages of the ring-supported segmented core rotor according to the present invention are numerous. The invention enables a rotating structure to effectively make use of the strength of the extremely high performance but highly directional fiber-reinforced plastic support ring 10. The segmented core redistributes stress in the core which allows lower performance and lower cost materials to be used without compromising overall rotor performance. This implies lower-density material will be sufficient for the core, which in turn leads to an overall reduction both of the rotating mass and the structural requirements of the support ring. The reduction of rotor mass represents lower kinetic energies, which must be safely contained in the event of failure of the rotor. A reduction of rotor mass improves rates of acceleration and reduces centrifuge drive horsepower requirements. Further, the reduced mass contributes to improved bearing wear and extended drive life of the centrifuge system.

The design of the present rotor is simplified in that improving speed performance or increasing margin of safety reduces to simply adding thickness to the support ring. The design concept effectively shifts load generated through rotational forces to a support structure (composite ring) which is most suited to accommodate them. This takes full advantage of the class of material generally referred to as advanced composites and reduces structural requirements of the core.

To augment the composite structure of the segmented core rotor, hybrid composite liners are designed in accordance with another aspect of the present invention. It will become apparent that the following discussion is applicable in general to centrifuge containers or buckets for holding samples to be carried by centrifuge rotors for centrifuging. In the past, centrifuge containers have been machined from metal using conventional metal working processes. Even thin walled containers can constitute a significant percentage of the rotor's total weight. This imposes additional forces on the load bearing surfaces of the rotor which in turn must be reinforced. In terms of customer convenience, it is preferred that the weight of centrifuge containers be kept light. The present invention makes use of composite technology to produce structurally superior centrifuge containers which offer significant weight reduction.

Figure 5:
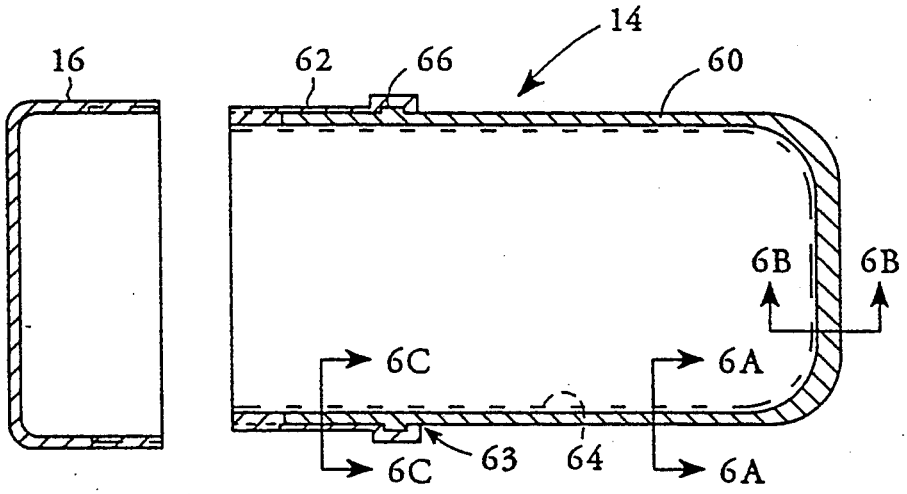
FIG. 5 is a longitudinal sectional view of a hybrid liner and closure in accordance with one embodiment of the present invention.
Figure 6A:
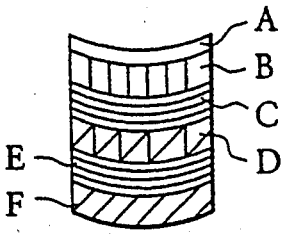
FIG. 6A is a sectional view taken along line 6A—6A in FIG. 5.
Figure 6B:
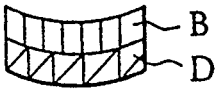
FIG. 6B is a sectional view taken along line 6B—6B in FIG. 5.

Referring to FIGS. 5 and 6, the container comprises a fiber-composite base 60 and a metal neck 62. The neck 62 is premachined from a lightweight metal such as aluminum alloy to obtain the cross section shown in the FIG. 6. Referring to FIGS. 6A and 6B, the base 60 comprises several layers of fiber materials having multistrand continuous fibers oriented in various directions impregnated in an epoxy resin matrix. In the illustrated embodiment, layer A consists of an epoxy film adhesive which aides in tacking down the first layer of fibers (layer B), and also acts as a supported bladder of the container. Layer B consists of fibers running double-helically at ±15° to the axis of the base. The fibers are wound such that they entirely enclose the end of the structure thus acting as the primary support layer for the container. Layer C consists of fibers running generally perpendicular (90°) to the horizontal axis in a small helical pitch (i.e. generally in the circumferential direction). Since these fibers reinforce the container in the circumferential direction, this layer is made relatively thicker than the other layers. Layer D consists of fibers wound at ±30° to the axis of the container in a double-helical fashion and covering the bottom of the base 60. Layer E consists of a thin layer of fibers wound helically at generally 90° to the axis of the container in the circumferential direction. This layer is optional but has been found to have the effect of "stabilizing" the adjacent helical winding to prevent it from uncoiling during subsequent handling and molding. Layer F is a fiber sheet which provides a highly compliant exterior layer. This exterior reinforcement eliminates surface cracks that might form on the otherwise resin-rich surface. FIG. 6B shows that the bottom of the base 60 has two layers of fiber material, layers B and D.

Figure 6C:
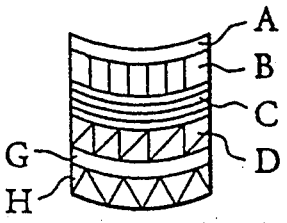
FIG. 6C is a sectional view taken along line 6C—6C in FIG. 5.

FIG. 6C illustrates the composition across the neck section. Instead of layer E, a layer G of adhesive tape is wrapped around the layer D of fibers. It has been found that layer E being circumferentially wound behaves like a coil in the axial direction which might become uncoiled when subject to axial tension. Thus, if the neck 62 is bonded to the layer E, shear stress at the bond arising from axial force on the neck (e.g. arising from internal pressure of the container upon centrifugation) could possibly uncoil the layer E. It has been found that by taping the layer D of 30° helically wound fibers in the region facing the neck 62, uncoiling of the layer E can be avoided. The layer G improves the structural integrity of the subsequent epoxy resin bonding between the neck 62 and the base 60. The layer G also tacks the cut fibers in layer D about the edge of the opening of the base 60. Layer H is the metal neck 62.

The process of forming the composite container and coupling to the aluminum neck is now described. A smooth mandrel 64 (shown in phantom in FIG. 5) having a profile as the internal geometry of the container is used as a tool around which carbon fibers are wound to form the container base 60. Specifically, layer A consisting of a double sided film adhesive is first wrapped around the mandrel. Carbon fiber is wound at ±15° to the axis of the container in a double-helical fashion such that the end of the mandrel is entirely covered by fiber forming the bottom of the container base. Carbon fiber is then wound in the circumferential direction to form layer C. Layer D is formed when carbon fiber is wound double-helically at ±30° to the axis of the container in the helical fashion. Finally, layer E is formed by winding carbon fiber in a circumferential direction, covering base 60 to the "neckline" 63. Layer G is taped around the layer D beyond the neckline 63 to the edge of the base.

The mandrel 64 now has a fiber wound dry preform of the base 60 which is to be molded with resin. The machined aluminum neck 62 is slipped over the dry carbon preform prior to epoxy resin molding. The inside surface of the neck 62 can be prepared by etching with chromate acid and priming with 3M EC-3960 primer to improve bonding to epoxy resin. Epoxy resin is introduced onto the dry preform through a vacuum/-pressure assisted method referred to in the art as vacuum assisted resin transfer molding. More particularly, the dry preform is placed in a sealed molding chamber, which is generally cylindrical defining the external diameter of the finished container 14. The molding chamber is evacuated and epoxy resin is introduced into the molding chamber under pressure. The pressure forces the epoxy resin into crevices in the preform to fully impregnate the preform. The epoxy is heat cured and the molded part is removed from the mandrel 64. The layer A after curing separates easily from the mandrel. The aluminum neck 62 is interlocked to the fiber reinforced epoxy base after the epoxy has cured in view of the annular channel 66.

Further machining of the aluminum neck 62 is possible. The neck can be machined to a desired external geometry and to form external threads to accommodate an internally threaded closure 16 for aerosol containment. It has been found that the heat curing process changes the geometry of the aluminum neck slightly. Thus the neck should be machined with threads after molding in order to obtain close tolerance. The aluminum neck 62 can be surface treated, e.g. anodized, to improve resistance to chemicals, a process which the composite base can withstand. A gasket (not shown) can be applied to improve sealing between the closure 16 and the neck 62.

Figure 7:
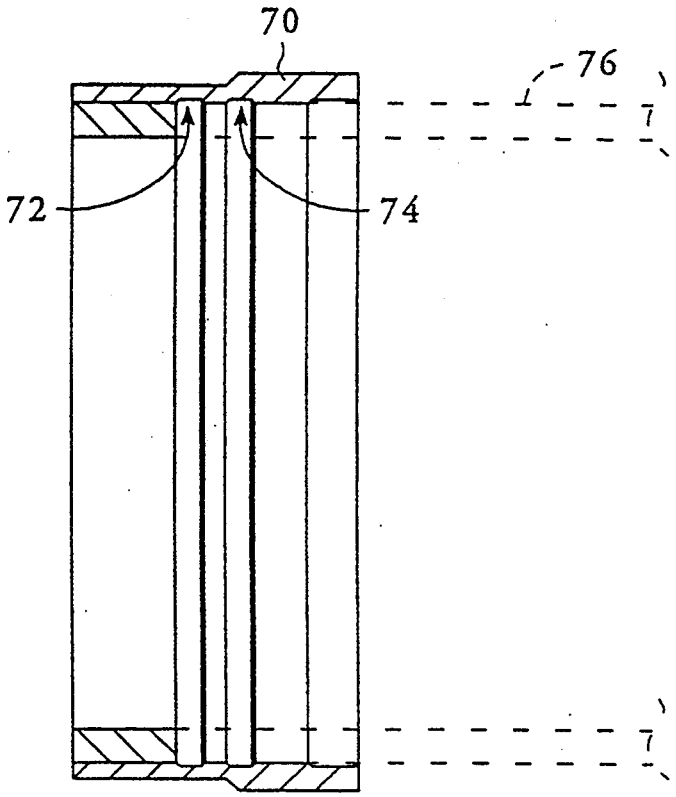
FIG. 7 is a longitudinal sectional view of a hybrid liner in accordance with another embodiment of the present invention.
Figure 8:
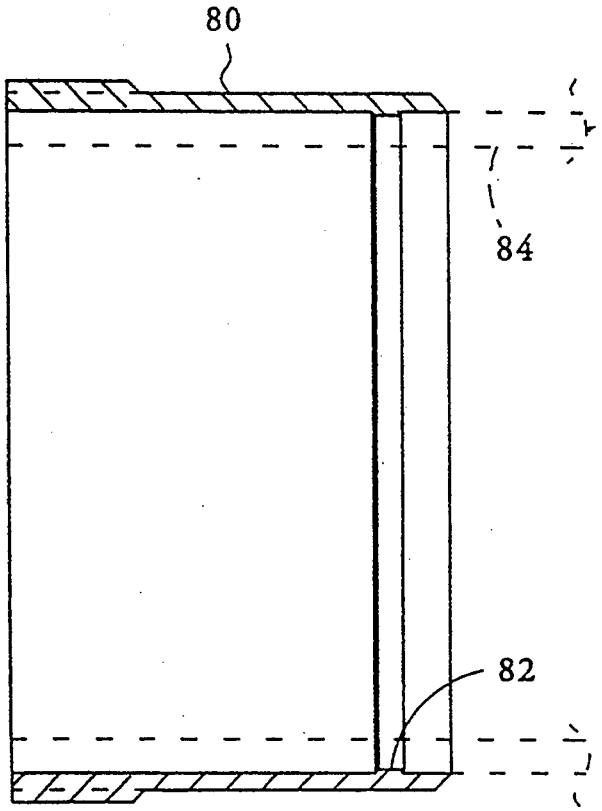
FIG. 8 is a longitudinal sectional view of a hybrid liner in accordance with a further embodiment of the present invention.

FIG. 7 and 8 illustrates two alternate embodiments of the metal neck. In FIG. 7, the neck 70 has double annular channels 72 and 74 for interlocking to the fiber reinforced base 76 (shown in phantom). In FIG. 8, the neck 80 has an annular ridge 82 which forms an interlocking structure with the base 84 (shown in phantom). In this embodiment, the base 84 extends to the edge of the neck 80.

There are numerous advantages of the hybrid liner/-container design. The detachable liner allows for the transportation of samples to and from the rotor in a sealed container. The liner utilizes high performance fiber-reinforced structural materials as the major structural component. Due to the flexibility of fiber placement in the winding process, high stress regions of the structure can be reinforced without significant weight penalties. The weight of the structure is significantly less than that of a metal structure of the same strength serving the same function. The bulk of the structure is comprised of carbon epoxy matrix which by density is approximately 50% lighter than aluminum (approximately 1.44 g/cc as opposed to 2.8 g/cc). The lightweight structure reduces the structural requirement of the rotor in supporting the centrifugal loading of the liners. This in turn results in faster acceleration and deceleration of the rotor and reduces the power requirement of the drive system. The molding process yields parts with identical geometries and consistent weights from part to part. The composite material is inherently chemically resistant. The amount of machining is reduced to a minimum which effectively reduces material waste. The aluminum neck molded with the fiber preform allows machining (fiber reinforced epoxy material alone is otherwise not suited to be machined) for close tolerance coupling to other parts (e.g. the threaded closure 16 in the embodiment described herein).

While the invention has been described with respect to the preferred embodiments in accordance therewith, it will be apparent to those skilled in the art that various modifications and improvements may be made without departing from the scope and spirit of the invention. Accordingly, it is to be understood that the invention is not to be limited by the specific illustrated embodiments, but only by the scope of the appended claims.

We claim:

1. A centrifuge rotor comprising:

a hub;

core segments movably coupled to the hub and extending radially outward beyond the hub to define a periphery, the core segments having means for supporting a sample to be centrifuged; and a ring fitted around the periphery of the core segments, said ring having a radius with respect to the hub which is sized relative to the core segments provide an interference fit between the ring and the periphery of the core segments such that the ring biases the core segments radially inwardly against the hub in a static non-centrifuging condition and supports the core segments against radially outward centrifugal forces upon centrifugation and there being no fixed structural connection between the ring and hub which would be subject to tensile stress upon centrifugation.

2. A centrifuge rotor as in claim 1 wherein the ring is made of fiber reinforced material.

3. A centrifuge rotor as in claim 1 wherein the core segments are sector shaped.

4. A centrifuge rotor as in claim 3 wherein each sector shaped core segment subtends 60°.

5. A centrifuge rotor as in claim 1 wherein the means for supporting said sample comprises a liner removably inserted into a hole in each core segment.

6. A centrifuge rotor as in claim 1 wherein the hub comprises a stem, top and bottom plates supported on the stem, the top and bottom plates are spaced apart to accommodate radial movement of the core segments between the plates.

7. A centrifuge rotor as in claim 6 wherein the top and bottom plates have locating pins distributed about their peripheries for guiding radial movement of the core segments.

8. A centrifuge rotor as in claim 1 further comprising a top windshield for reducing windage.

9. A centrifuge rotor as in claim 8 further comprising a bottom windshield for reducing windage.

10. A centrifuge rotor as in claim 1 wherein the means for supporting said sample comprises a container having a hybrid structure of metal and fiber reinforced material.

11. A centrifuge rotor as in claim 1 wherein the hub comprises means for guiding radial movement of the core segments.

12. A centrifuge rotor comprising: a hub;

sector shaped core segments, each segment having a narrow end which is slidably supported on the hub and a wide end, the core segments having means for supporting a sample to be centrifuged; and a ring fitted radially against the wide ends of the core segments, said ring having a radius with respect to the hub which is sized relative to the core segments to provide an interference fit between the ring and the wide ends of the core segments such that the ring biases the narrow ends of the core segments radially inwardly against the hub in a static non-centrifuging condition and supports the core segments against radially outward centrifugal forces upon centrifugation, and there being no fixed structural connection between the ring and hub which would be subject to tensile stress upon centrifugation.

13. A centrifuge rotor as in claim 12 wherein the ring is made of fiber reinforced material.

14. A centrifuge rotor as in claim 12 wherein the hub comprises a stem, and top and bottom plates supported on the stem, the top and bottom plates are spaced apart to support and accommodate radial movement of the core segments between the plates.

15. A centrifuge rotor as in claim 14 wherein the top and bottom plates have locating pins distributed about their peripheries for guiding radial movement of the core segments.

16. A centrifuge rotor as in claim 12 wherein the means for supporting said sample comprises a container having a hybrid structure of metal and fiber reinforced material.

17. A centrifuge rotor as in claim 12 wherein the hub comprises means for guiding radial movement of the core segments.

18. A centrifuge rotor comprising:

a hub;

core segments, each having an end facing radially inward to the hub which is movably coupled to and positioned around the hub, the core segments having means for supporting a sample to be centrifuged; and a ring fitted radially outside the core segments, said ring having a radius with respect to the hub which is sized relative to the core segments to provide an interference fit between the ring and the core segments such that the ring biases the ends of the core segments radially inwardly against the hub in a static non-centrifuging condition and supports the core segments against radially outward centrifugal forces upon centrifugation, and there being no fixed structural connection between the ring and hub which would be subject to tensile stress upon centrifugation.

19. A centrifuge rotor as in claim 18 wherein the hub comprises a stem, and top and bottom plates supported on the stem, the top and bottom plates are spaced apart to support and accommodate radial movement of the core segments between the plates.

20. A centrifuge rotor as in claim 19 wherein the top and bottom plates have locating pins distributed about their peripheries for guiding radial movement of the core segments.

* * * * *